US012303958B2

(12) United States Patent
Bach et al.

(10) Patent No.: US 12,303,958 B2
(45) Date of Patent: May 20, 2025

(54) MANUFACTURING TOOLING AND METHODS FOR PRODUCING PUSH BUTTON CONTAINER CLOSURES

(71) Applicant: Consumer Convenience Technologies LLC, Dayton, OH (US)

(72) Inventors: James Bach, Dayton, OH (US); R. Peter Stodd, Vandalia, OH (US)

(73) Assignee: Consumer Convenience Technologies LLC, Dayton, OH (US)

( * ) Notice: Subject to any disclaimer, the term of this patent is extended or adjusted under 35 U.S.C. 154(b) by 0 days.

(21) Appl. No.: 18/250,084

(22) PCT Filed: Jan. 27, 2022

(86) PCT No.: PCT/US2022/014047
§ 371 (c)(1),
(2) Date: Apr. 21, 2023

(87) PCT Pub. No.: WO2023/146522
PCT Pub. Date: Aug. 3, 2023

(65) Prior Publication Data
US 2024/0390969 A1 Nov. 28, 2024

(51) Int. Cl.
*B21D 22/28* (2006.01)
*B65D 43/02* (2006.01)

(52) U.S. Cl.
CPC ..... *B21D 22/28* (2013.01); *B65D 43/0202* (2013.01); *B65D 2543/00092* (2013.01); *B65D 2543/00935* (2013.01)

(58) Field of Classification Search
CPC ..... B21D 22/28; B21D 51/38; B21D 51/383; B21D 51/386; B21D 51/44
See application file for complete search history.

(56) References Cited

U.S. PATENT DOCUMENTS

2009/0293572 A1 12/2009 McEldowney et al.
2013/0299496 A1* 11/2013 Forrest ..... B21D 51/38 413/8

(Continued)

OTHER PUBLICATIONS

International Searching Authority, Search Report and Written Opinion issued in PCT/US2022/014047, mailed Apr. 12, 2022 (11 pages).

*Primary Examiner* — Teresa M Ekiert
(74) *Attorney, Agent, or Firm* — Wood Herron & Evans LLP

(57) ABSTRACT

A tooling assembly and related method of manufacture for making a push button container closure are provided. Advantageously, the tooling assembly only includes one "all in one" press station at which all score lines are cut into the blank that is being formed into the container closure. Furthermore, the profiles and features of the container closure are generally rotationally symmetrical except at the score lines, and as such, no orientation dimples or other features need to be formed in the blank or used to maintain an exact rotational position of the blank as it moves between the various press stations of the tooling assembly. As a result, the manufacturing tooling itself is easier to use and more efficient because at least one press/scoring station and the orientation equipment of conventional tooling designs are no longer necessary in this process.

20 Claims, 9 Drawing Sheets

(56) References Cited

U.S. PATENT DOCUMENTS

| | | | | |
|---|---|---|---|---|
| 2014/0110408 | A1* | 4/2014 | Mitchell | B21D 51/44 413/1 |
| 2016/0376070 | A1 | 12/2016 | Stodd | |
| 2018/0071810 | A1 | 3/2018 | Carstens et al. | |
| 2018/0339814 | A1 | 11/2018 | Stodd et al. | |
| 2019/0224733 | A1* | 7/2019 | Pinosa | B21C 1/28 |
| 2019/0256247 | A1 | 8/2019 | Stammen et al. | |

* cited by examiner

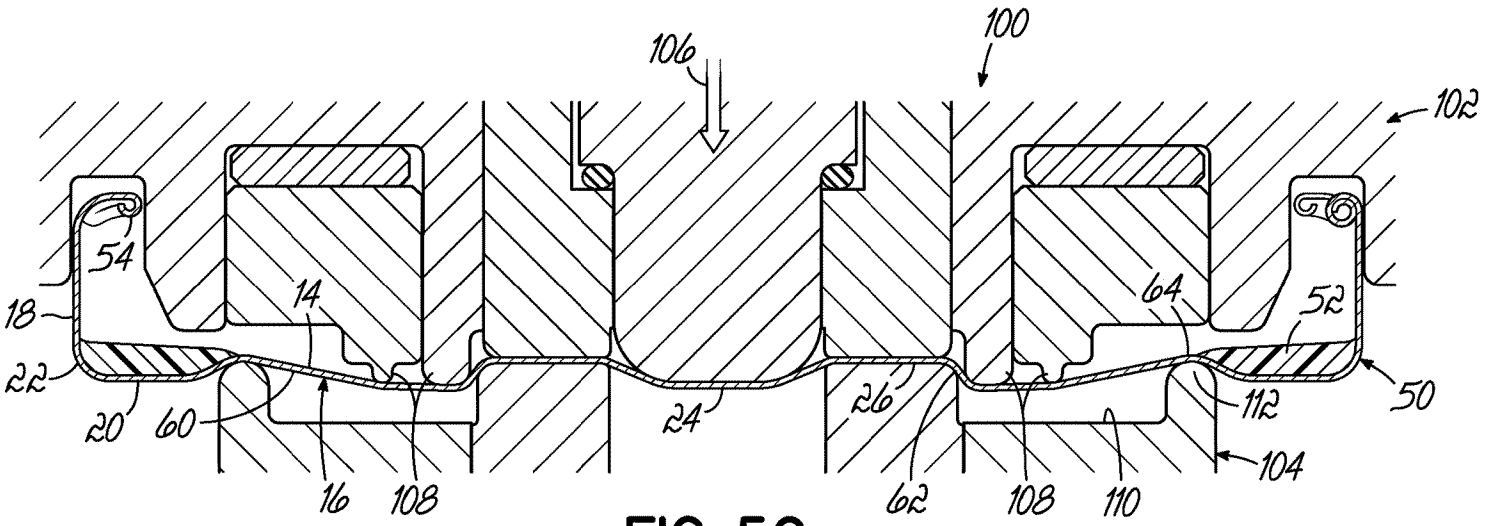
FIG. 5C
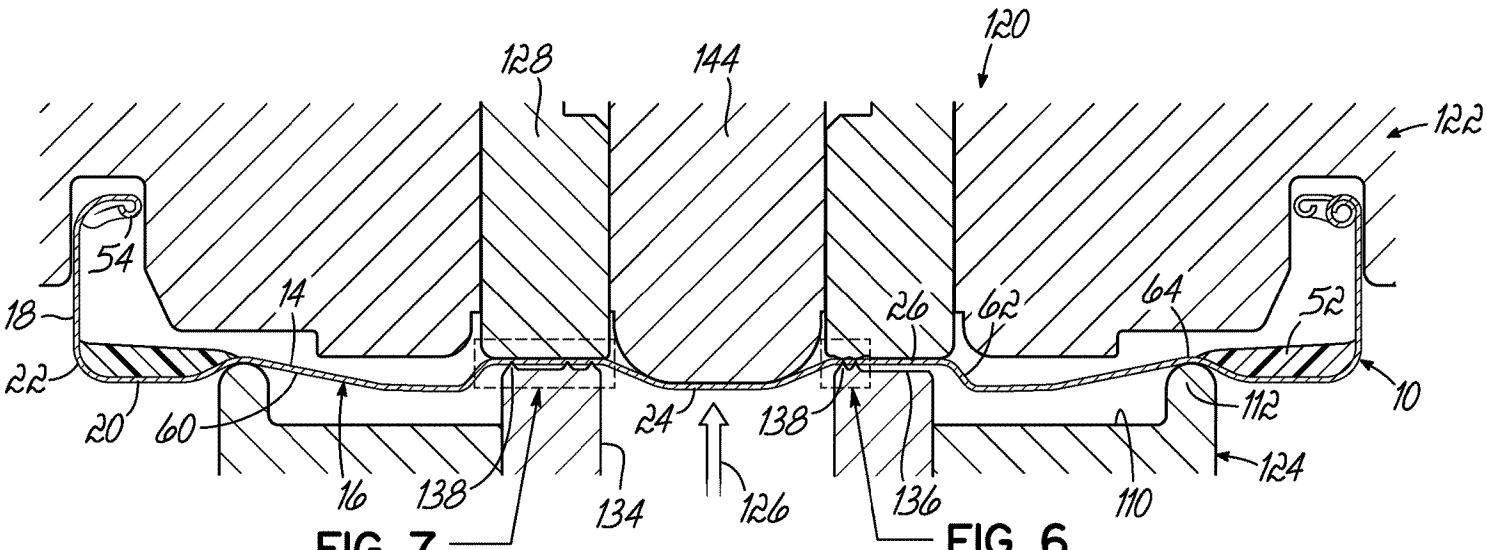
FIG. 6
FIG. 5D
FIG. 7

MANUFACTURING TOOLING AND METHODS FOR PRODUCING PUSH BUTTON CONTAINER CLOSURES

CROSS-REFERENCE TO RELATED APPLICATION

This application is a national phase application of, and claims priority to, International Patent Application No. PCT/US2022/014047, filed on Jan. 27, 2022, the disclosure of which is incorporated by reference herein in its entirety.

TECHNICAL FIELD

The invention relates to manufacturing tooling and methods for forming container closures from sheet metal, specifically container closures that are used for enclosing a food or beverage container that may be pressurized, and which include features for releasing any pressure difference across the closure before the closure is removed to open the container.

BACKGROUND

Metal container closures are constructs structured to close a substantially enclosed space defined by a container body. Several types of container closures for food and beverage applications are known and widely used in this field, as now described.

In one embodiment, the container is a food container that includes a food can body and a food can container closure (or food can end). That is, a container body is a food can body, such as but not limited to, a can body for sardines. After the food can body is filled with a food, the food can end is coupled to the food can body. The food can end includes an end panel and a tear panel, wherein the tear panel is separated from the end panel by a score line that is generally continuous and surrounding the entire tear panel. For example, the end panel is substantially the perimeter portion of the food can end and the tear panel is a large central portion thereof. A pull tab is coupled to the tear panel adjacent the score line. The pull tab is lifted to create an initial break at the score line, then pulled to separate the tear panel from the end panel.

In another embodiment, the container is a beverage container that includes a beverage can body and a beverage can container closure (or beverage can end). That is, the container body is a beverage can body, such as but not limited to, a can body for carbonated beverages. The can end includes an end panel and a tear panel, which is separated from portions of the end panel by a score line. In such applications, a lift tab is coupled to the end panel adjacent the tear panel. When the lift tab is actuated, i.e., lifted, a portion of the lift tab engages the tear panel and causes the tear panel to move relative to the end panel. As the tear panel moves relative to the end panel, the tear panel and the end panel separate at the score line. The tear panel does not fall into the beverage can body, but rather, flexes toward the beverage can body so that a consumer may drink the liquid via a container opening that appears as a result of moving the tear panel.

In a further embodiment, the container may be a glass jar. That glass jar includes a base and an upwardly depending sidewall. The distal portion of the side wall includes external threads. In this embodiment, the container closure is a twist lug, or, as used herein, a "lid." That is, a "lid" means a closure structured to be removably coupled to ajar and which includes a generally planar top and a depending sidewall with internal threads. As is known, food stored in glass jars typically requires some process retort (heating/cooling) to sterilize/cook the contents. In the process, the product is exposed to a vacuum during the cooling process. This vacuum exposes the underside of the lid closure to a negative pressure, which tends to make the closure difficult to open/twist off the jar. One solution to this problem is to provide a push button on the lid. That is, a push button is a type of tear panel that is raised for access. As with the can ends described above, the lid defines an end panel and a tear panel. The tear panel includes a raised portion that is the push button. Further, an arcuate score line defines the tear panel. When a user opens the jar, the user engages the button causing the tear panel to tear at least along the score line allowing some ambient atmosphere to enter the enclosed space, thereby equalizing pressure across the lid and therefore making removal of the lid from the container easier.

In each of the container closures described above, the tear panel, and therefore the container opening, is defined at least in part by a score line. The score line is typically formed by a blade engaging a blank. The blade thins the metal at the score line. That is, in a tooling assembly, an upper tooling includes a blade and a lower tooling includes an anvil opposite the blade. A metal blank is disposed between the upper tooling and the lower tooling. When the upper tooling and the lower tooling are brought together, the blade engages the upper surface of the blank and deforms the metal. That is, the metal under the blade flows to either side of the blade in a cutting-like action, thereby creating a thin remainder portion (in cross-section across a thickness through the blank/closure, which is the score line.

Particularly in container closures and/or lid designs having the push button type of tear panel, relatively complex patterns of profile elements and score lines having different depths of cut into the material of the container closure may be collectively formed on the container closure to help cause the push button to accurately and reliably apply force to the region of the score line which is to be severed when opening of the lid is desired. For example, a main score line may be provided in one region and one or more anti-fracture score lines may be provided to assure that any breaks in the container closure caused by application of force at the push button are limited to occurring at the main score line. The shape and profile of the push button itself can also be specially configured to contribute to this functionality. Consequently, forming a container closure of this type from a sheet metal "blank" has involved a multi-step process with multiple die sets and press equipment used to form all of these features in the container closure. For example, one press station may cut ancillary scores into the container closure and then another press station may cut the main score(s) into the container closure. As will be readily understood, the orientation and positioning of the container closure is critical to maintain between these different press stations because a misalignment may lead to a push button and/or score lines that do not function as intended (and in some cases, cannot hold the pressure difference needed to seal and store the food or beverage products within the jar-type container). Such adds significant cost and further complexity to the container closure manufacturing process and equipment.

It would therefore be desirable to improve manufacturing tooling and methods for container closures of this type. More particularly, it would be desirable to provide tooling and methods that can more efficiently make the various profile shapes, features, and score lines desired in a container closure, as compared to conventional manufacturing processes.

SUMMARY

These and other technical advantages are achieved by the embodiments of manufacturing methods and tooling of the present invention. To this end, the manufacturing methods and tooling of this invention allow for removal of one or more manufacturing stations, which thereby makes the process of making container closures quicker and more efficient. Likewise, the critical need to maintain alignment of shells between press stations can be dispensed with, which improves reliability of the process as well.

In a first set of embodiments, a method of manufacturing a push button container closure from a sheet of material is provided. The method includes providing a blank of a container closure including a generally planar center panel and a sidewall extending from a periphery of the center panel at a corner junction for processing at a series of press stations. The first press station deforms the center panel of the container closure to include a bubble projecting upwardly from a remainder of the center panel. The second press station further deforms the center panel at the bubble to form a central button and a depressed annular region surrounding the central button. The central button is located in relative elevation below the corner junction of the container closure after this deforming step. The third press station deforms an outer region of the center panel located between the depressed annular region and the sidewall to reshape the center panel at the outer region and thereby move the central button upwardly closer to an elevation of the corner junction. The fourth press station scores the depressed annular region surrounding the central button to provide main scores and ancillary scores into an upper surface of the container closure. All scores cut into the container closure are formed only at the fourth press station in a single compression action. A selected one of the main scores is cut deeper into material of the container closure than all other scores such that the central button can be pushed to sever the center panel at the selected one of the main scores to release a pressure differential across the container closure.

In one embodiment, the fourth press station includes a second die tool with a plurality of cutting projections and a first die tool opposite the second die tool. The step of scoring using the fourth press station further includes cutting the main scores and the ancillary scores into the upper surface of the container closure simultaneously by insertion of the plurality of cutting projections into the container closure at the fourth press station as the first and second die tools move towards one another.

In another embodiment, the fourth press station includes a second die tool with a plurality of cutting projections and a first die tool opposite the second die tool, the first die tool having raised anvils extending above adjacent portions of the first die tool. The raised anvils are also aligned with selected cutting projections on the second die tool that are configured to form the main scores. The step of scoring using the fourth press station further includes supporting a lower surface of the container closure with the raised anvils of the first die tool as the selected cutting projections of the second die tool are inserted into the upper surface of the container closure opposite the raised anvils to thereby produce the main scores.

In a related embodiment, the first die tool of the fourth press station includes a planar support surface at all portions except adjacent to the raised anvils. The step of scoring using the fourth press station then includes supporting a lower surface of the container closure with the planar support surface of the first die tool as the cutting projections of the second die tool are inserted into the upper surface of the container closure to produce the ancillary scores. The planar support surface of the first die tool may be positioned 0.001 inch (appx. 25.4 μm) below a top of the raised anvils, to define an additional spacing between the first and second die tools when pressed together to lower forces applied by the fourth press station to the container closure at positions where the ancillary scores are cut into the upper surface of the container closure.

In yet another embodiment, the step of scoring using the fourth press station also includes cutting the upper surface of the container closure at the main scores such that each of the main scores is a curved line including a concave nose portion including an apex extending towards the central button, and convex line portions extending from both ends of the concave nose portion with each including an apex extending away from the central button.

In a further embodiment, the step of scoring using the fourth press station includes producing a primary score and a secondary score as the as the only main scores in the container closure. The primary score has a larger depth into the upper surface of the container closure than the secondary score while also being positioned between the central button and the secondary score. The secondary score therefore serves as an anti-fracture score while the primary score is configured for severing to release the pressure differential across the container closure. The step of producing the primary score and the secondary score may further include cutting the upper surface of the container closure such that about 0.001 inch (appx. 25.4 μm) of material thickness remains in the container closure under the primary score, and cutting the upper surface of the container closure such that about 0.002 inch (appx. 50.8 μm) of material thickness remains in the container closure under the secondary score.

In one embodiment, the step of scoring using the fourth press station includes cutting the upper surface of the container closure at the ancillary scores such that each of the ancillary scores is defined by one or more of circular line arc portions generally concentric with the central portion, and radial line portions extending towards and away from a center of the central button. In a related embodiment, the step of cutting the upper surface of the container closure at the ancillary scores further includes cutting at least three of the ancillary scores to include both circular line arc portions and radial line portions to thereby collectively define circular trapezoid shapes for these ancillary scores. The circular trapezoid shapes are continuous except where interrupted by a region of the main scores. These ancillary scores generally surround a periphery of the central button and the main scores on the container closure such that force applied to the central button is directed to focus towards severing the container closure at the main score.

In another embodiment, the step of scoring using the fourth press station further includes cutting the upper surface of the container closure such that about 0.0045 inch (appx. 114.3 μm) of material thickness remains in the container closure under each of the ancillary scores.

In a further embodiment, the method also includes moving the container closure from the first press station to the second press station, then to the third press station and the fourth press station such that the steps of deforming and scoring can be performed sequentially on the container closure. No orientation dimples or features are formed in the container closure for guiding the moving of the container closure between press stations because an angular orientation of the container closure does not need maintained with all main scores and ancillary scores being formed by the same fourth press station, and all other press stations producing circumferentially symmetrical deformations in the container closure.

In a second set of embodiments, a tooling assembly is provided for manufacturing a push button container closure from a blank, with the blank including a generally planar center panel and a sidewall extending from a periphery of the center panel at a corner junction. The tooling assembly includes first, second, third, and fourth press stations. The first press station includes first and second die tools that press together to deform a center panel of the container closure to include a bubble projecting upwardly from a remainder of the center panel. The second press station includes first and second die tools that press together to further deform the center panel at the bubble, to form a central button and a depressed annular region surrounding the central button. The central button is located in relative elevation below the corner junction after the second press station's deforming. The third press station includes first and second die tools that press together to deform an outer region of the center panel which is located between the depressed annular region and the sidewall, so as to reshape the center panel at the outer region and thereby move the central button upwardly closer to an elevation of the corner junction of the container closure. The fourth press station includes first and second die tools that press together to score the depressed annular region surrounding the central button to provide main scores and ancillary scores into an upper surface of the container closure. The second die tool includes a plurality of cutting projections that cut into the upper surface to form the main scores and the ancillary scores when the first and second die tools are pressed together. One of the cutting projections is larger in size than a remainder of the cutting projections to form a selected one of the main scores which is cut deeper into material of the container closure than all other scores. The central button can thus be pushed to sever the center panel at the selected one of the main scores to release a pressure differential across the container closure. The fourth press station is advantageously configured to cut all scores into the container closure only at the fourth press station and by using a single compression action. To this end, the container closure is scored at only one of the press stations in the tooling assembly.

In one embodiment, the first and second die tools of the fourth press station are each hollow cylindrical dies defining annular-shaped surfaces that engage with only the depressed annular region when the first and second die tools are pressed together to score the container closure.

In another embodiment, the first die tool of the fourth press station further includes raised anvils extending above adjacent portions of the first die tool, these raised anvils being aligned with selected cutting projections on the second die tool of the fourth press station that are configured to form the main scores. The raised anvils are positioned to support a lower surface of the container closure as the selected cutting projections of the second die tool are inserted into the upper surface of the container closure opposite the raised anvils to produce the main scores.

In related embodiments, the raised anvils include planar upper surfaces that extend between curved sides that taper away from the planar upper surfaces. The planar upper surfaces are fully aligned with and follow a path defined by a cutting edge of the selected cutting projections on the second die tool. In this regard, the planar upper surfaces of each of the raised anvils defines a width between the curved sides of about 0.005 inch (appx. 127 μm).

In another embodiment, each of the raised anvils and each of the selected cutting projections configured to form the main scores follows a curved line path when viewed in plan view. The curved line path has a concave nose portion with an apex extending towards an axial center of the first and second die tools, and convex line portions extending from both ends of the concave nose portion and each including an apex extending away from the axial center of the first and second die tools.

In yet another embodiment, the second die tool of the fourth press station includes only two selected cutting projections and the first die tool of the fourth press station includes only two raised anvils. One of the selected cutting projections that is closer to an axial center of the second die tool is sized larger than the other of the selected cutting projections. As such, the larger selected cutting projection cuts a primary score into the upper surface of the container closure that has a larger depth than a secondary score cut by the other of the selected cutting projections (the smaller one). For example, the larger one of the selecting cutting projections is spaced about 0.001 inch (appx. 25.4 μm) from one of the raised anvils when the first and second die tools of the fourth press station are pressed together, thereby leaving about 0.001 inch (appx. 25.4 μm) of material thickness in the container closure under the primary score. The other of the selected cutting projections is spaced about 0.002 inch (appx. 50.8 μm) from another of the raised anvils when the first and second die tools are pressed together, thereby leaving about 0.002 inch (appx. 50.8 μm) of material thickness in the container closure under the secondary score. The secondary score is thereby configured to serve as an anti-fracture score while the primary score is configured for being severed to release the pressure differential.

In a further embodiment, the first die tool of the fourth press station further includes a planar support surface at all portions except adjacent the raised anvils. The planar support surface is positioned to support the lower surface of the container closure as the cutting projections of the second die tool are inserted into the upper surface of the container closure to produce the ancillary scores. The planar support surface of the first die tool is positioned 0.001 inch (appx. 25.4 μm) below planar upper surfaces of the raised anvils, to thereby define an additional spacing between the first and second die tools when pressed together around a location where the ancillary scores are formed in the container closure.

In one embodiment, each of the cutting projections configured to form the ancillary scores follows a path when viewed in plan view that is defined by one or more of circular line arc portions generally concentric with an axial center of the second die tool, and radial line portions extending towards and away from the axial center of the second die tool. At least three of the cutting projections forming ancillary scores have both circular line portions and radial line portions to thereby define circular trapezoid shapes for these ancillary scores. The circular trapezoid shapes are continuous except where interrupted by a region of the cutting projections that are configured to make the main scores. The first die tool of the fourth press station further includes a planar support surface spaced from the raised anvils, with each of the cutting projections configured to form the ancillary scores being spaced about 0.0045 inch (appx. 114.3 μm) from the planar support surface when the first and second die tools are pressed together at the fourth press station. This leaves about 0.0045 inch (appx. 114.3 μm) of material thickness in the container closure under each of the ancillary scores.

In these embodiments, none of the first, second, third, or fourth press stations forms orientation features in the container closure because an angular orientation of the container closure can be varied when moving between each of the press stations (e.g., without adversely affecting the formation of the features desired on the container closure).

It will be appreciated that each of the embodiments described for the manufacturing method and tooling assembly may be combined together in any combination or sub-combination, without departing from the scope of the present invention.

BRIEF DESCRIPTION OF THE DRAWINGS

The accompanying drawings, which are incorporated in and constitute a part of this specification, illustrate one or more embodiments of the invention and, together with a general description of the invention given above, and the detailed description given below, serve to explain the invention.

FIG. 5C is a cross-sectional side view of the third station of manufacturing tooling operating on the container closure of FIG. 3C to produce the container closure (in progress) of FIG. 3D.

FIG. 5D is a cross-sectional side view of the fourth station of manufacturing tooling operating on the container closure of FIG. 3D to produce the finalized form of the container closure of FIG. 3E.

DETAILED DESCRIPTION

Figure 1:
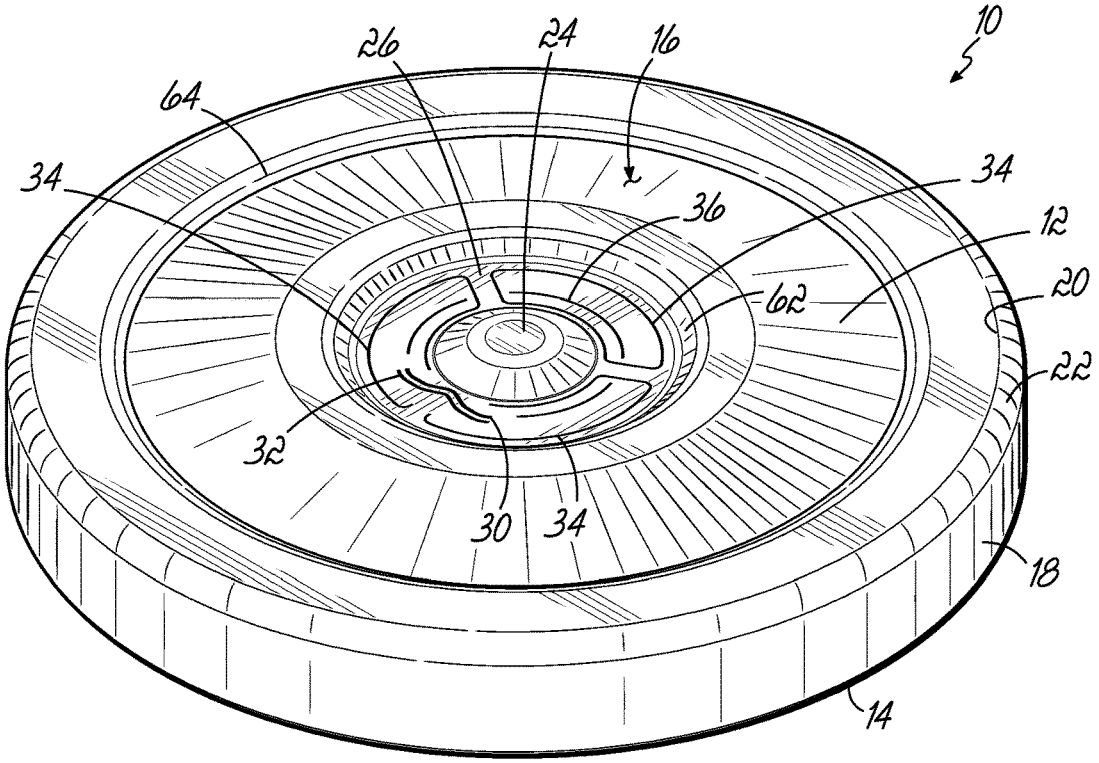
FIG. 1 is a top front perspective view of one embodiment of a push button container closure made using the manufacturing tooling and methods of the present invention.
Figure 2:
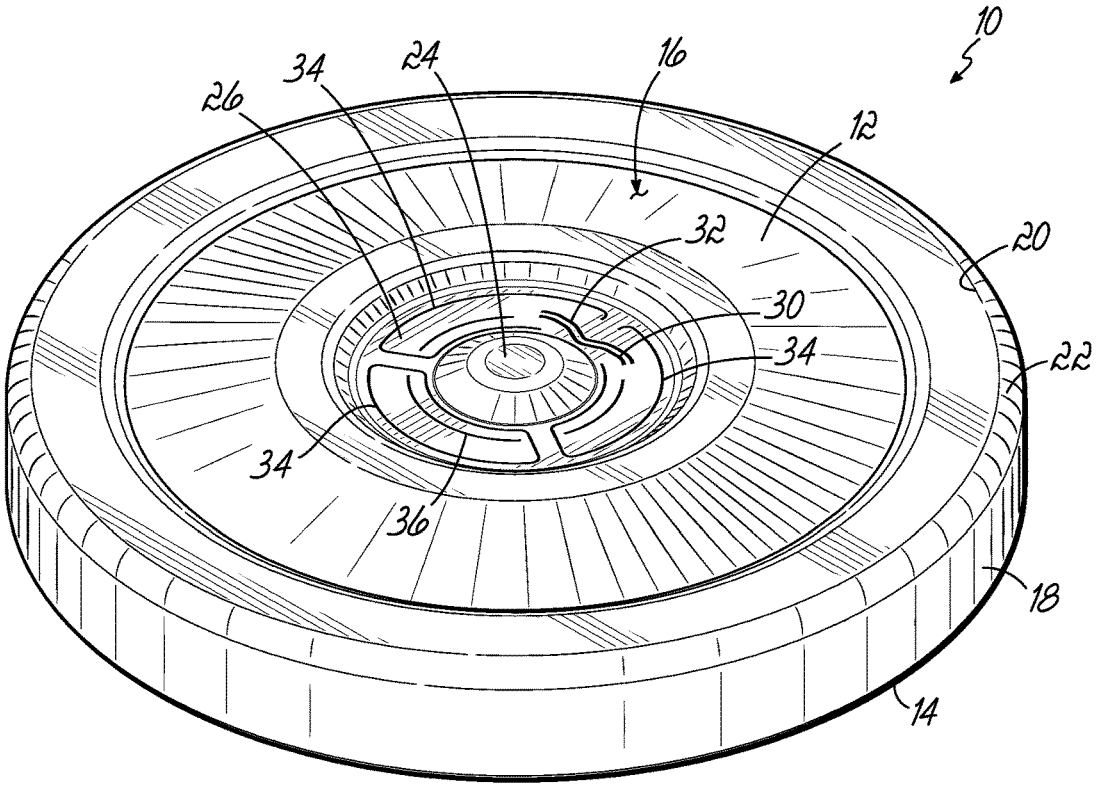
FIG. 2 is a top rear perspective view of the container closure of FIG. 1.

As described in summary above, a tooling assembly and its related method of manufacture for making a push button container closure are provided to address some of the deficiencies in this field. Advantageously, the tooling assembly only includes one "all in one" press station at which all score lines are cut into the blank that is being formed into the container closure. Furthermore, the profiles and features of the container closure are generally rotationally symmetrical except at the score lines, and as such, no orientation dimples or other features need to formed in the blank or used to maintain an exact rotational position of the blank as it moves between the various press stations of the tooling assembly. As a result, the manufacturing tooling itself is easier to use and more efficient because at least one press/scoring station and the orientation equipment of conventional tooling designs are no longer necessary in this process. More technical advantages will be evident from the further detailed description of the tooling assembly and the method provided below.

Before describing the tooling assembly and its operation in detail, reference is made to FIGS. 1-2 and 4-4A, each of which shows different views of one embodiment of a push button container closure (also referred to as a "lid" in this art) that may be formed using the tooling assembly and method of the present invention. It will be understood that design variations are possible from this container closure shown, as this is just one example embodiment to illustrate the functionality achieved. The container closure 10 shown in these Figures includes a generally planar main body or center panel 12 having a product side 14 facing downwardly in these views and a customer side 16 facing upwardly in these views (references made to when the container closure 10 is in use). The container closure 10 is structured to be removably coupled to a container such as a jar (not shown). The container closure 10 further includes a sidewall 18 that extends in one direction from a periphery 20 of the center panel 12, the sidewall 18 typically including interior threads (not shown). The container closure 10 thereby defines a corner junction 22 connecting the annular sidewall 18 to the center panel 12.

The jar for engaging with such a container closure 10 would include an upper opening with exterior threads. Thus, the interior threads engage the jar exterior threads to couple the container closure 10 to the container/jar in use, and thereby form an enclosed space within the jar. As is known and as initially described in the Background section above, a product disposed in the enclosed space can be heated, e.g., for sterilization. When the jar cools, a vacuum or partial vacuum is created within the jar. The vacuum, or partial vacuum, further draws the container closure 10 into engagement with the top of the jar. To loosen the container closure 10 for removal, a user must overcome this bias, or, the bias must be eliminated or reduced. Thus, it is desirable to form the container closure 10 so as to selectively allow ambient atmosphere into the jar to release the vacuum and make the container closure 10 easier to remove. In the present example, the container closure 10 contains one or more scores (also known as score lines) cut into the upper surface (customer side 16) thereof to provide such functionality.

The score lines may be defined by shifted material score lines and/or by traditional score lines, which in either case is an area of the container closure 10 at which the body has been thinned by scoring at least one surface thereof. It is understood that when a score line is acted upon with sufficient force or pressure, the body separates at the score line thereby creating an opening. The container closure 10 therefore includes an "end panel" and a "tear panel" that separate along the opening, consistent with the known types of container closures described previously. The opening formed in this exemplary embodiment is a limited opening that merely allows for atmospheric pressure to remove any vacuum or pressure difference defined across the two sides 14, 16 of the container closure 10, e.g., a large aperture is not produced by the severing along the score line(s).

In this example embodiment of the container closure 10, a plurality of score lines are disposed around a central button 24 located at an axial center of the center panel 12. The central button 24 is surrounded by a depressed annular region 26 formed in the center panel 12, and the score lines are all located at this depressed annular region 26 so as to collectively define a force concentrating construction that helps direct force applied to the central button 24 to be specifically applied to help shear open the container closure 10 along a primary main score 30. In addition to the primary main score 30, the container closure 10 includes a secondary main score 32 which serves the purposes of an anti-fracture score as described further below. The plurality of score lines also includes a plurality of ancillary scores 34 located around the main scores 30, 32. The details of the scores 30, 32, 34 is shown most clearly in FIG. 4A and now described.

Many of the ancillary scores 34 are defined by circular line arc portions 34*a* and radial line portions 34*b* which collectively combine to form one or more circular trapezoid shapes around the circumference of the central button 24. In the embodiment shown, each circular trapezoid shape extends over an arc of slightly less than 120 degrees as a result of the circular trapezoid shapes being spaced from one another along the radial line portions 34*b*. One of the circular trapezoid shapes defines a fully contiguous perimeter, while the other two circular trapezoid shapes are broken perimeters as a result of interruption by a region where the main scores 30, 32 are positioned. The small in size gaps between the circular trapezoid shapes of the ancillary scores 34 and the nearly full perimeter coverage around the central button 24 except at the main scores 30, 32 is what collectively contributes to directing or focusing force applications to the button 24 to be applied mostly to the region where the main scores 30, 32 are positioned (as well as to the "links" of remaining unbroken material between the circular trapezoid shapes. Although three circular trapezoid shapes are included in this example, four, five, or even more circular trapezoid shapes may be defined by the ancillary scores 34 in other embodiments of the container closure 10, and the force concentrating function of such will still be similar in those alternative embodiments. Each of the circular trapezoid shapes further includes an interior score line 36 formed within the periphery defined by the circular line arc portions 34*a* and the radial line portions 34*b*, these interior score lines 36 specifically also being circular line arc portions in the illustrated embodiment.

Returning to the main scores 30, 32, each of these defines an overall generally straight curvilinear line. To this end, the primary main score 30 is shown in these Figures to include a first convex line portion 40, a generally arcuate or concave nose portion 42, and a second convex line portion 44 on an opposite end of the nose portion 42 from the first. Thus, the nose portion 42 extends between and is contiguous with the first and second convex line portions 40, 44. The concave nose portion 42 defines an apex pointing directly towards the central button 24, which allows the primary main score 30 to focus any force application from the central button 24 at this nose portion 42 and specifically at this apex. The force concentration design advantageously enables the primary main score 30 to shear or break at a lower force application than any alternative scores without force concentration shapes and features. It will be understood that the break generally occurs first along the apex of the nose portion 42, so this is also where atmosphere will escape through the container closure 10 when actuated. Each of the first and second convex line portions 40, 44 also includes an apex that generally extend away from the central button 24. The primary main score 30 crosses over the path of the two interrupted circular trapezoid shapes of the ancillary scores 34 generally along the first and second convex line portions 40, 44, such that these convex line portions 40, 44 are respectively positioned at least in part within the corresponding perimeters of the circular trapezoid shapes.

In the exemplary embodiment, the secondary main score 32 defines a similar shape of an overall generally straight curvilinear line that follows in parallel path alongside the primary main score 30. As noted above, the secondary main score 32 functions as an anti-fracture score as a result of placement adjacent the primary main score 30, and as a result of the primary main score 30 being cut deeper into the material of the container closure 10. The provision of the secondary main score 32 makes sure that force applied to this region and transferred from the central button 24 remains principally applied to the primary main score 30 until this shears open, e.g., forces are not allowed to transmit past the primary main score 30 so as to cause unpredictable breaks and fractures elsewhere in the container closure 10. Although not described or numbered in detail, the secondary main score 32 is therefore understood to also include the same features of first and second convex line portions and a concave nose portion therebetween. It will also be understood that more than one anti-fracture score may be provided in other embodiments without departing from the scope of this invention.

Each of the scores 30, 32, 34 described in this pattern on the container closure 10 has a residual. As is known, and as used herein, the "residual" is the thickness of the material remaining underneath the score following scoring/cutting operations. The primary main score 30 will always have the smallest residual, so as to cause opening or shearing to occur there, with the secondary main score 32 having larger residual and each of the ancillary scores 34 even larger residual than the secondary main score 32. In the example embodiment shown here, the upper surface 16 of the container closure 10 is cut such that the residual under the primary main score 30 is about 0.001 inch (appx. 25.4 μm)

of material, the residual under the secondary main score 32 is about 0.002 inch (appx. 50.8 μm) of material, and the residual under each of the ancillary scores 34 is about 0.0045 inch (appx. 114.3 μm) of material. It will be understood that the residuals of remaining material may vary, such as by plus or minus 0.0002 inch (appx. 5.1 μm) for the main scores 30, 32 and by plus or minus 0.001 inch (appx. 25.4 μm) for each of the ancillary scores 34, and that the residual size may be varied so long as the relationship of size between then remains similar to that in this exemplary embodiment. In summary, the collection of scores and profile features on the container closure 10 configures same for the use on a jar-like container that can hold vacuum pressure as described above.

Figure 3A:
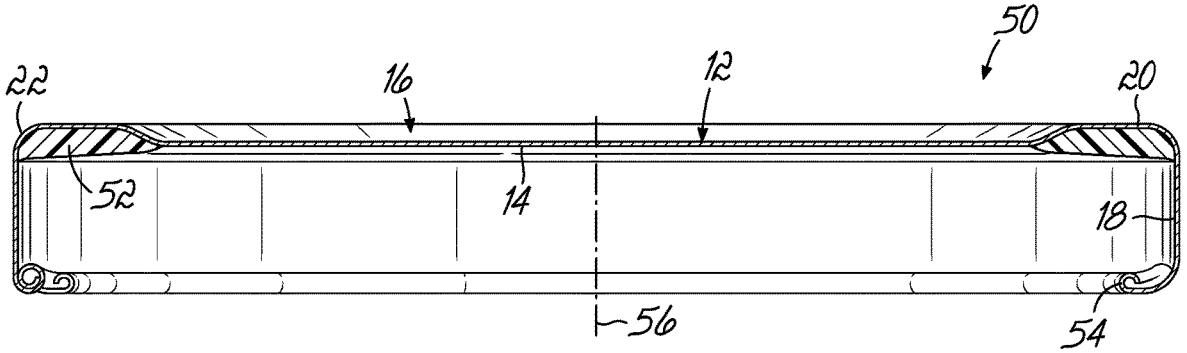
FIG. 3A is a cross-sectional view of a container closure (specifically a "blank" to be used to form the container closure) with a center panel in a generally planar initial configuration before processing at a first station of manufacturing tooling.

Now turning with reference to FIGS. 3A-3E, a series of cross-sectional views taken from the side of the container closure 10 are shown in detail, specifically showing the progression from a blank 50 defined in part by a sheet of material at the beginning of the manufacturing process in FIG. 3A to the finalized container closure 10 as described in detail in the exemplary embodiment above. FIG. 3A shows the blank 50 as originally provided before modifications are made by a series of press stations to be described further below. The blank 50 has already been provided with the sidewall 18 that projects downwardly from the corner junction 22 defined along a periphery 20 of a generally planar center panel 12 in this state. Although not shown in detail, the sidewall 18 may also already include any internal threading (not shown) that is to engage with external threads on a jar/container as well as a terminal edge curl 54 to avoid a sharp leading edge on the container closure 10, and further, a sealing gasket material 52 may also already be positioned along the lower or product side 14 of the center panel 12 adjacent the corner junction 22 (e.g., where the product side 14 of the container closure 10 will engage with a top surface or rim on the jar). It will be appreciated that such features can alternatively be provided in a different order in other embodiments, and such manufacturing process steps are not the focus of the present invention. Instead, the manufacturing method and steps of interest are those which act upon the center panel 12 to produce the central button 24 and the plurality of scores 30, 32, 34 that allow the container closure 10 to function for holding and then releasing a pressure differential across the sides of the container closure 10 when in use on a jar/container.

Figure 3B:
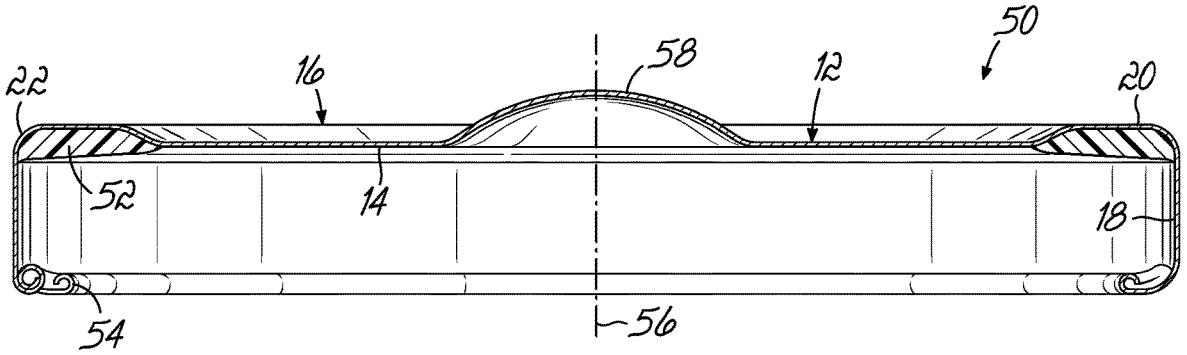
FIG. 3B is a cross-sectional view of the container closure of FIG. 3A, with a central bubble formed in the center panel following processing at the first station.

In a first process step, a first press station deforms the blank 50 along the center panel 12, which is generally planar before the deformation as shown in FIG. 3A. More specifically, the center panel 12 is deformed along a center thereof (e.g., around an axial center shown by axis 56 in these views) to produce a rounded bubble 58 projecting upwardly from a remainder of the center panel 12, this remainder being annular in shape and remaining generally planar as shown in FIG. 3B. The bubble 58 specifically projects in height or relative elevation above the corner junction 22 even though a majority of the center panel 12 on the blank 50 is originally disposed below in relative elevation the periphery 20 and the corner junction 22. Thus, in the first process step, the material of the center panel 12 is generally deformed or pressed upwardly towards the upper or customer side 16.

Figure 3C:
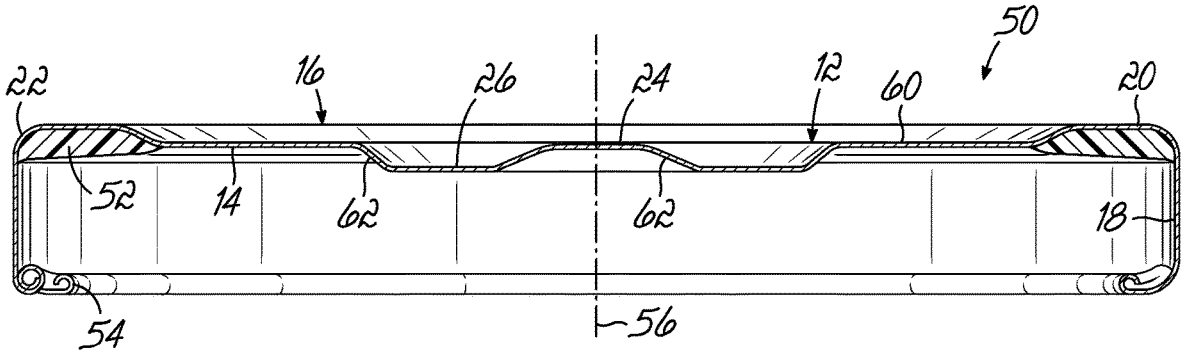
FIG. 3C is a cross-sectional view of the container closure of FIG. 3B, with a button formed where the central bubble was formed following processing at a second station of manufacturing tooling.

In a second process step, a second press station further deforms the blank 50 of FIG. 3B to form the central button 24. In this regard, the further deformation occurs at and around the region of the bubble 58, and this deformation specifically produces the central button 24 surrounded by a depressed annular region 26 as shown most clearly in FIG. 3C. The central button 24 is shaped circular and generally planar as shown in FIG. 3C and in the previous detailed views of the container closure 10, and the vertical relative elevation of the central button 24 is below the elevation of the corner junction 22 along the periphery 20 and generally concurrent in relative elevation to a remainder of the center panel 12 located radially outside or beyond the depressed annular region 26. Thus, in this second process step, the material of the center panel 12 is generally deformed and pressed downwardly towards the lower or product side 14. The depressed annular region 26 is further lower in relative elevation as compared to the central button 24 so that the central button 24 extends upwardly for being pressed by a consumer or user when the container closure 10 is finalized and installed onto ajar or similar container. The depressed annular region 26 is also generally planar along its annular shape, following this further deformation. As also shown in FIG. 3C, this deformation step results in angled profiles or steps 62 being formed to connect the central button 24 to the inner side of the depressed annular region 26 and to connect the outer side of the depressed annular region 26 to a remainder of the center panel 12, which is hereinafter referred to as an outer region 60 of the center panel 12. Both of the steps 62 at this point in the manufacturing process define relatively gentle slopes transitioning between the connected elements, meaning that the transitions are not provided as vertical wall portions or nearly vertical wall portions in the container closure 10.

In a third process step, a third press station deforms the outer region 60 of the center panel 12 to reshape this outer region 60 to include angled profiles rather than just a planar sheet of material. To this end, the material of the center panel 12 is deformed or pressed upwardly again towards the upper or customer side 16 in this third process step, and this causes portions of the outer region 60 as well as the central button 24 to move upwardly in relative elevation to a point substantially as high as the corner junction 22 at the top of the sidewall 18, as shown most clearly in FIG. 3D. The step 62 located between the outer region 60 and the depressed annular region 26 is accordingly made somewhat sharper, e.g., steeper in angle, as a result of this deforming, but this step 62 is still not substantially close to vertical. Likewise, a V-shaped dip profile 64 is thus formed along an outer part of the outer region 60 adjacent to the periphery 20 connected to the corner junction 22. Nevertheless, the depressed annular region 26 is now offset from surrounding portions of the center panel 12 to help focus application of force on the central button 24 to the score lines as previously described when the container closure 10 is in use. Up to this point in the manufacturing process, all features added to the blank 50 are circumferentially symmetrical, meaning that the exact rotational orientation and alignment of the blank 50 as it moves between press stations does not need to be maintained.

Figure 3D:
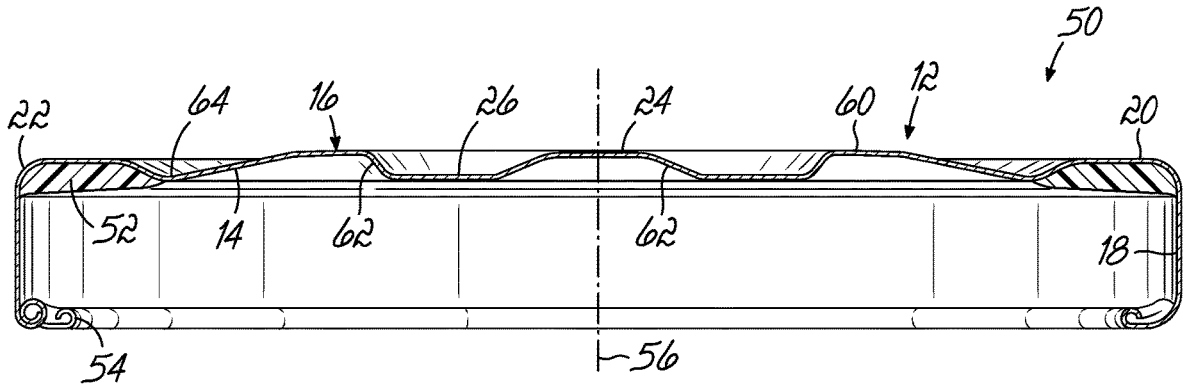
FIG. 3D is a cross-sectional view of the container closure of FIG. 3C, with additional annular features following processing at a third station of manufacturing tooling.
Figure 3E:
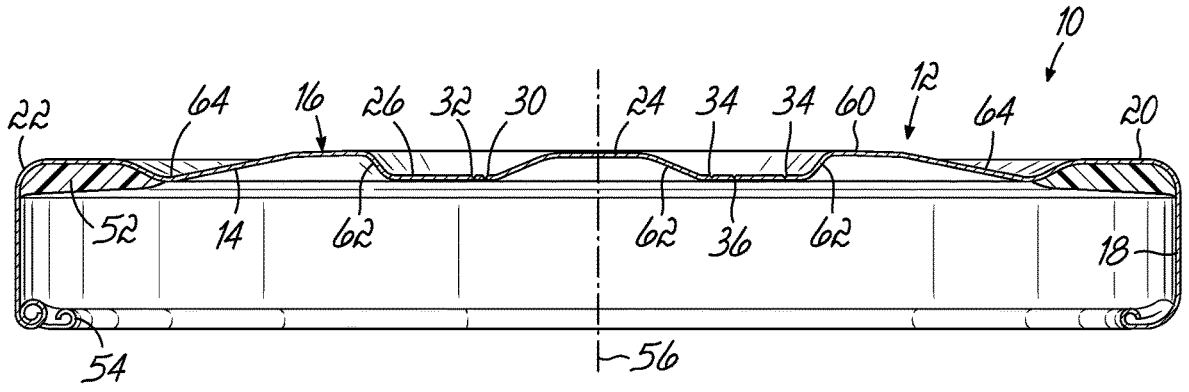
FIG. 3E is a cross-sectional view of the container closure of FIG. 3D, with several score lines added to the closure following processing at a fourth station of manufacturing tooling, the container closure being in a finalized state in this view.
Figure 4:
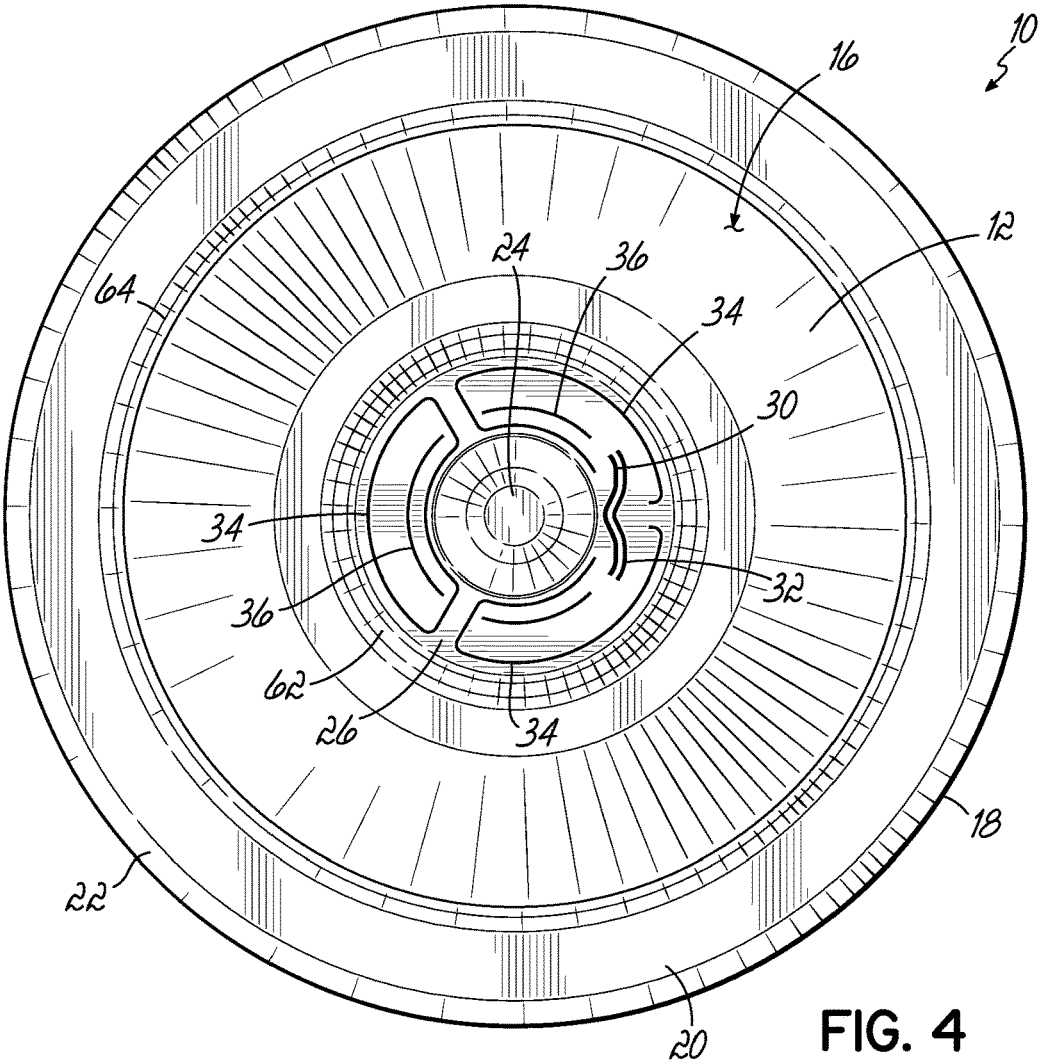
FIG. 4 is a top plan view of the container closure of FIG. 3E, showing the various score lines in further detail.
Figure 4A:
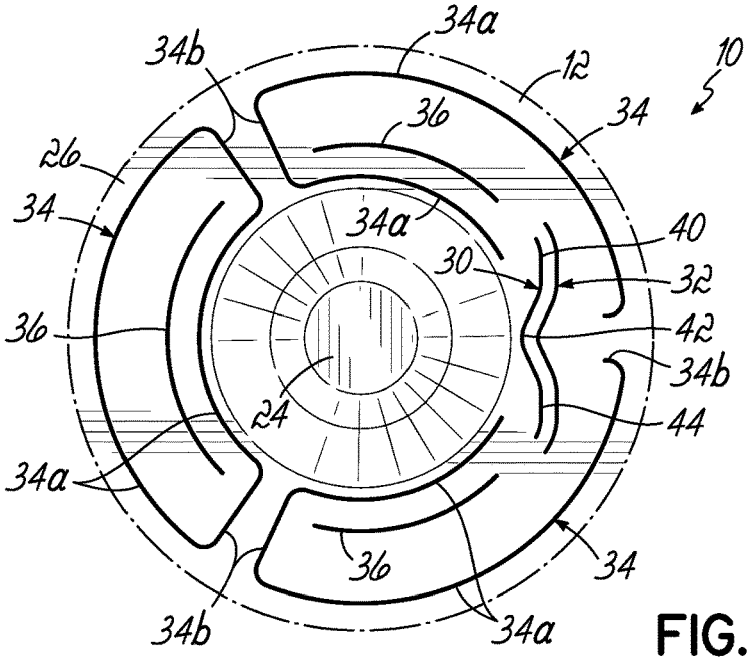
FIG. 4A is a detail top view of the score lines formed on the container closure of FIG. 4.

In a fourth process step, a fourth press station scores the depressed annular region 26 of the blank 50 to finalize formation of the container closure 10, this final container closure 10 being visible then in FIG. 3E. The cross-section of FIG. 3E is taken such that the apexes of the primary main score 30 and the secondary main score 32 are visible along one side of the central button 24, while several of the ancillary scores 34 are visible along an opposite side of the central button 24. The shape and profile of the center panel 12 is not significantly altered by the fourth press station, as this "all in one" station is configured to work principally on providing all scores to be cut into the container closure 10, and specifically in a single compression action. After scoring, the container closure 10 is in finalized form and is ready for deployment and use with jar-like containers. Once again, no orientation maintaining needs done because there are no further press stations after the scoring done at the fourth process step, and this advantageously simplifies the manufacturing tooling as well as the process needed to form the container closure 10 as shown from the blank 50.

Now turning with reference to FIGS. 5A-5D, the various press stations referred to above as part of the tooling assembly for manufacturing the push button container closure 10 are shown in further detail and in operation. It will be understood that these cross-sectional views are schematic and in some places simplified from the actual equipment used, for the purposes of clear illustration of the operation and important parts thereof. Beginning with FIG. 5A, a first press station 70 of the manufacturing tooling is shown to include a first die tool 72 on an upper side thereof in this illustration and a second die tool 74 opposing on the lower side thereof. The blank 50 of FIG. 3A is loaded into the first press station 70 in an upside-down orientation from what was previously shown, e.g., the product side 14 faces towards the first die tool 72. The first die tool 72 may include a recess for receiving the sidewall 18 as shown, as this portion of the blank 50 is not actively deformed or pressed by the first press station 70. It will be understood that the first and second die tools 72, 74 may be reversed in orientation in other embodiments.

Figure 5A:
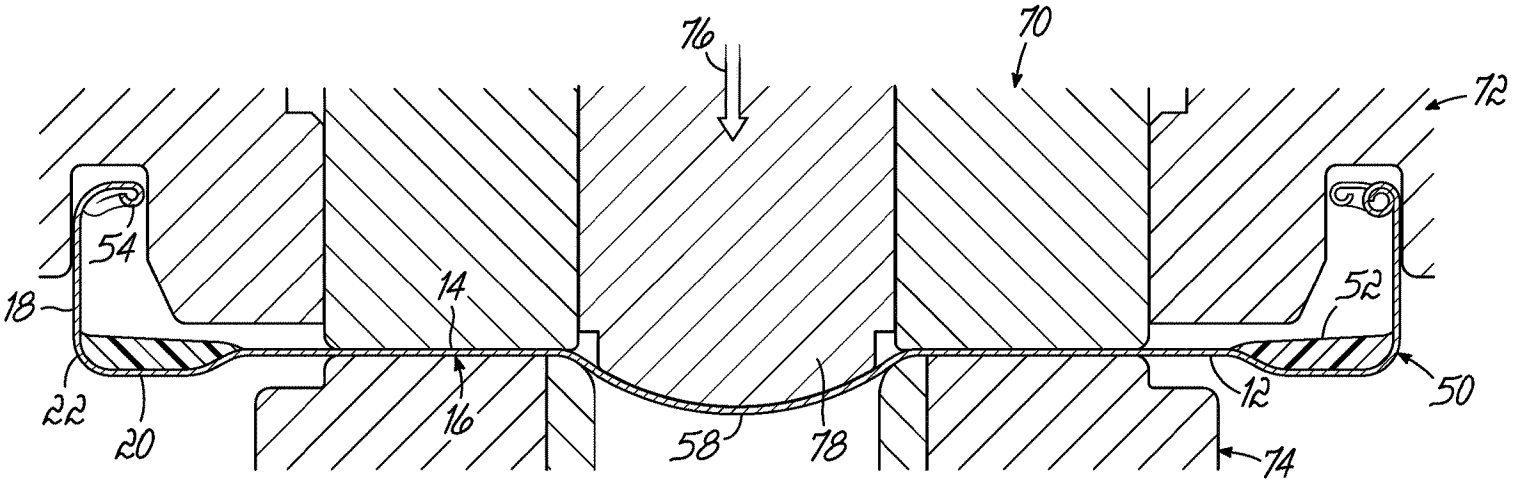
FIG. 5A is a cross-sectional side view of the first station of manufacturing tooling operating on the container closure of FIG. 3A to produce the container closure (in progress) of FIG. 3B.

FIG. 5A shows operation of the first press station 70 to deform the center panel 12 of the blank 50. To this end, the first die tool 72 is moved along the direction of arrow 76 in FIG. 5A into engagement with a center of the center panel 12. The central portion 78 of the first die tool 72 has a rounded shape configured to form the bubble 58, with the opposite portion of the second die tool 74 being open so that the first die tool 72 can push the material of the center panel 12 into this opening in the second die tool 74 when brought together relative to other portions of the center panel 12, which are clamped between two generally planar facing portions of the first and second die tools 72, 74. As can be seen from this view in FIG. 5A, the blank 50 is therefore converted from the first state shown and described with respect to FIG. 3A above, to the second state as shown in FIG. 3B (and also generally shown in FIG. 5A). The first and second die tools 72, 74 are then moved away from one another to release the blank 50 for movement to the second press station.

Figure 5B:
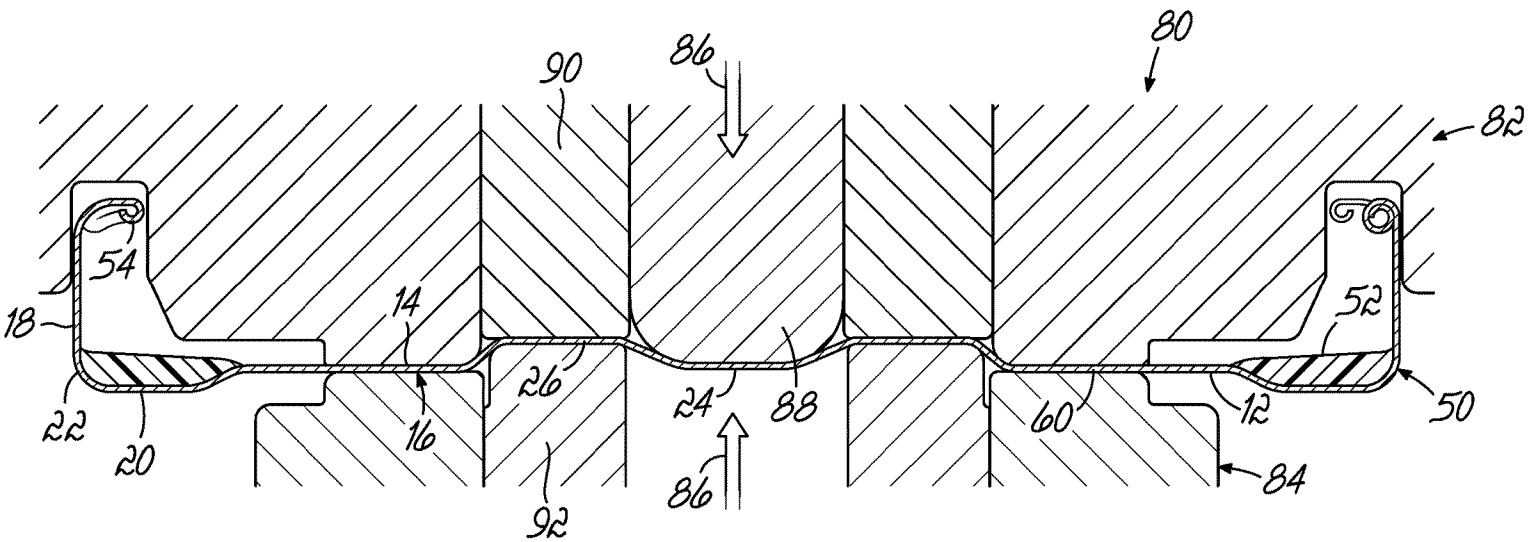
FIG. 5B is a cross-sectional side view of the second station of manufacturing tooling operating on the container closure of FIG. 3B to produce the container closure (in progress) of FIG. 3C.

FIG. 5B shows the second press station 80 of the tooling assembly in operation. The blank 50 from the first press station 70, which includes the bubble 58, is loaded between a first die tool 82 on an upper side of the second press station 80 and a second die tool 84 on a lower side thereof. With the product side 14 of the blank 50 again facing upwardly in this view, the first die tool 82 again includes an annular recess sized to receive the sidewall 18 which is not to be deformed or otherwise acted upon at the second press station 80. It will be understood that the insertion of the sidewall 18 into the recess may assure proper alignment of the blank 50, but the rotational orientation is not critical in view of the circumferential symmetry of the blank 50 at this step in the manufacturing process.

FIG. 5B shows operation of the second press station 80 to further deform the center panel 12 of the blank 50. To this end, the first and second die tools 82, 84 are moved along the direction of arrows 86 in FIG. 5B into engagement with the center panel 12 located therebetween. The first and second die tools 82, 84 again clamp an outermost part of the center panel 12 (e.g., the portion to later define the outer region 60) between outer parts of these die tools 82, 84. The central portion of the first die tool 82 has an inner die piece 88 with a generally flat terminal end for engaging with the bubble 58 to form a central button 24, and also has an outer die piece 90 that clamps against a similar outer die piece 92 of the second die tool 84 to deform the center panel 12 and form a depressed annular region 26 that is generally planar and surrounding the central button 24. An opening is provided inside the outer die piece 92 of the second die tool 84, thereby allowing the terminal end of the inner die piece 88 of the first die tool 82 to push the material of the center panel 12 at the bubble 58 into this opening to elevate the central button 24 being formed "above" the depressed annular region 26. As can be seen from this view in FIG. 5B, the blank 50 is therefore converted from the state shown and described with respect to FIG. 3B above, to the state as shown in FIG. 3C (and also generally shown in FIG. 5B). The first and second die tools 82, 84 are then moved away from one another to release the blank 50 for movement to the third press station.

FIG. 5C shows the third press station 100 of the tooling assembly in operation. The blank 50 from the second press station 80, which includes the central button 24 and the depressed annular region 26, is loaded between a first die tool 102 on an upper side of the third press station 100 and a second die tool 104 on a lower side thereof. With the product side 14 of the blank 50 again facing upwardly in this view, the first die tool 102 again includes an annular recess sized to receive the sidewall 18 which is not to be deformed or otherwise acted upon at the third press station 100. Once again, the rotational orientation is not critical in view of the circumferential symmetry of the blank 50 at this step in the manufacturing process.

FIG. 5C shows operation of the third press station 100 to deform the center panel 12 of the blank 50, specifically along the outer region 60 positioned between the previously-formed depressed annular region 26 and the corner junction 22 at the periphery 20 of center panel 12. The interior of the first die tool 102 and the interior of the second die tool 104 are essentially identical to those elements in the die tools of the second press station 80, which effectively just clamps the central button 24 and the depressed annular region 26 in position while the outer region 60 is being actively shaped by deformation as the first and second die tools 102, 104 are brought together as indicated by arrow 106. To this end, the first die tool 102 now includes exterior (from an annular shape) press elements 108 located just outside the position of the depressed annular region 26, and the second die tool 104 includes a recess 110 opposite these press elements 108 to allow for deformation and movement of the outer region 60 relative to the depressed annular region 26 and relative to the corner junction 22. The recess 110 is delimited on an inner side by the aforementioned interior of the second die tool 104 and on an outer side by a press projection 112 that is configured to add the V-shaped dip profile 64 into the center panel 12 at a region adjacent the periphery 20 thereof. The operation of the various press elements 108 and press projections 112 as the first and second die tools 102, 104 come together is to deform the outer region 60, including sharpening the angle of the step 62 between the outer region 60 and the depressed annular region 26 and lifting the relative elevation of the outer region 60 (and also the central button 24) to again be generally concurrent with the periphery 20 and corner junction 22. As can be seen from this view in FIG. 5C, the blank 50 is therefore converted from the state shown and described with respect to FIG. 3C above, to the state as shown in FIG. 3D (and also generally shown in FIG. 5C). The first and second die tools 102, 104 are then moved away from one another to release the blank 50 for movement to the fourth press station. No orientation dimples or other rotational orientation maintaining steps need to be done for this movement to the next station, as set forth above.

Figure 6:
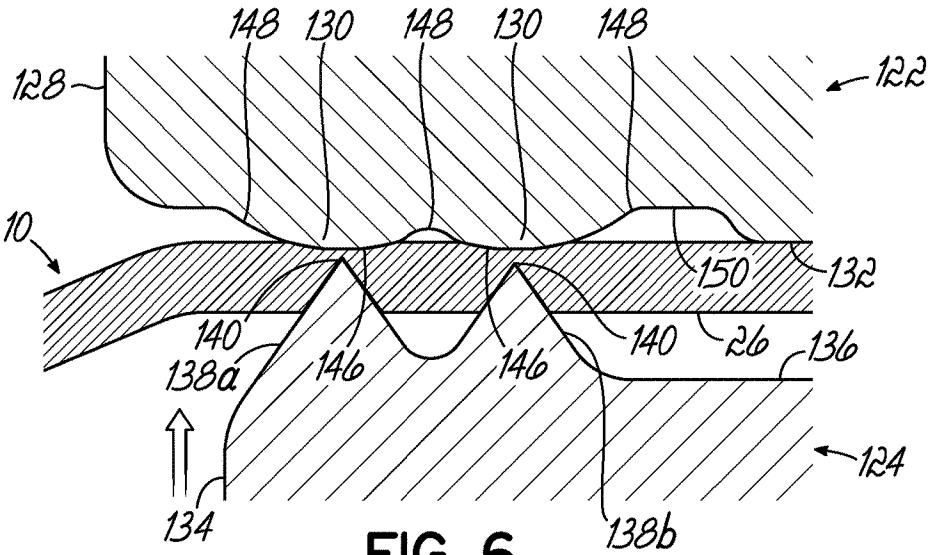
FIG. 6 is a detailed side view of one portion of the fourth station of manufacturing tooling of FIG. 5D, to show further features along this portion of the fourth station when operating on the container closure.
Figure 7:
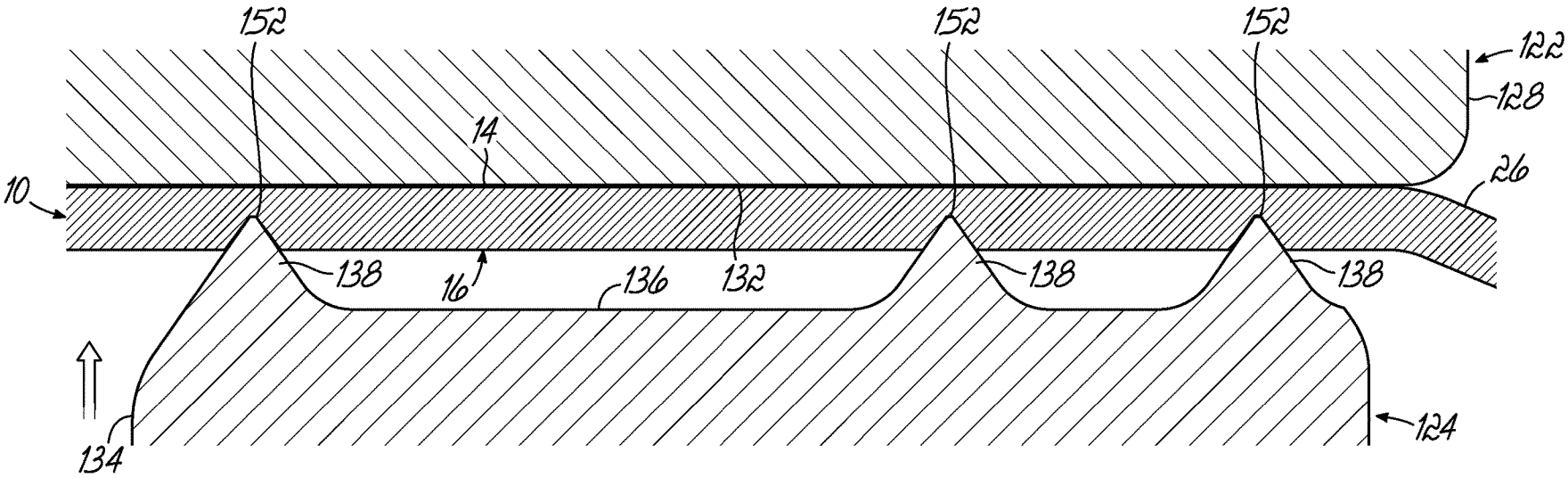
FIG. 7 is a detailed side view of another portion of the fourth station of manufacturing tooling of FIG. 5D, to thereby show further features along this portion of the fourth station when operating on the container closure.
Figure 8:
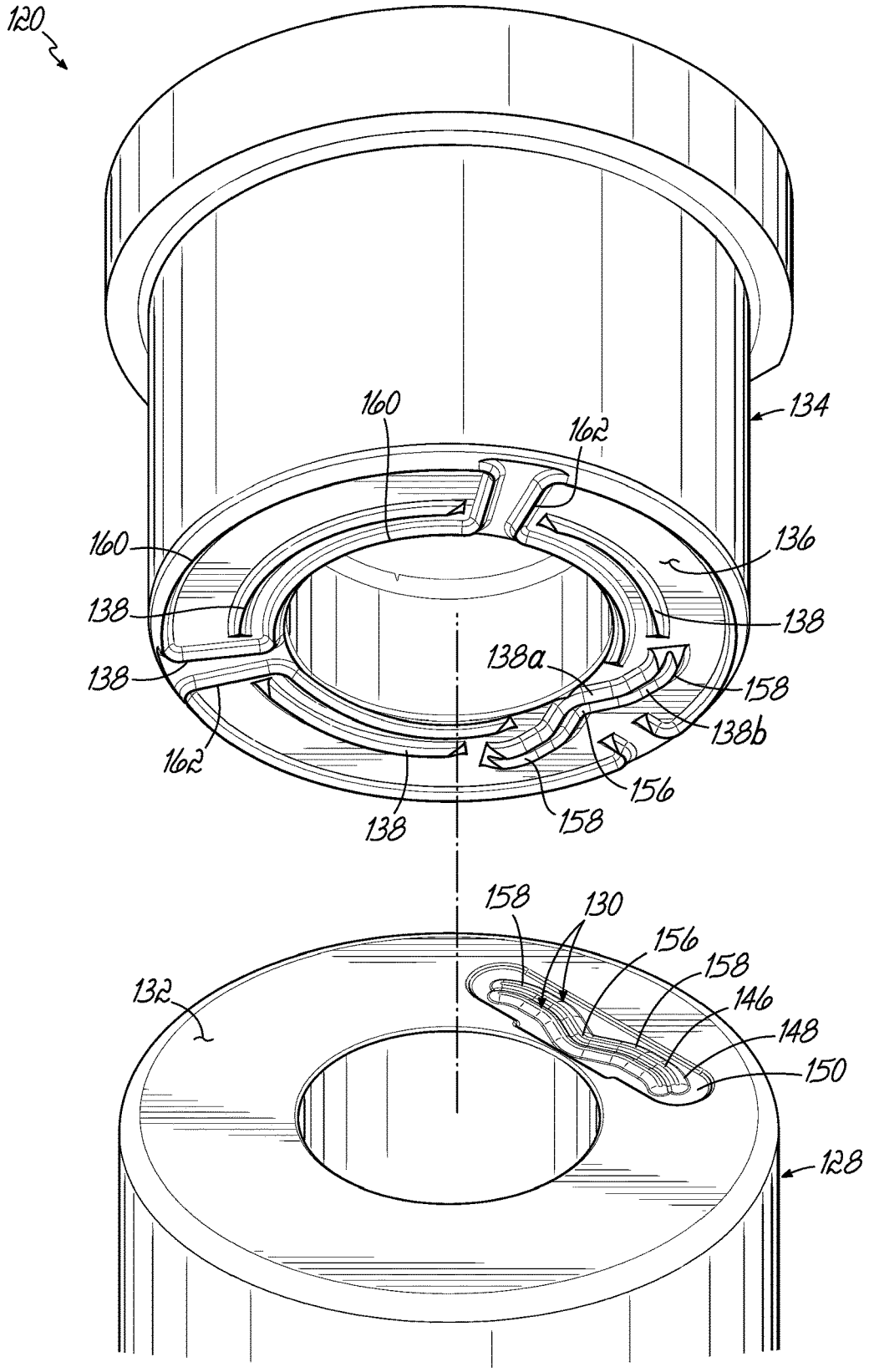
FIG. 8 is a perspective view of upper and lower dies defining the manufacturing tooling of the fourth station.

Now turning to FIG. 5D, this Figure shows the fourth press station 120 of the tooling assembly in operation. Additional views of certain portions of the fourth press station 120 and portions of a first die tool 122 and a second die tool 124 there are shown in FIGS. 6-8. This "all in one" scoring station advantageously cuts all scores into the blank 50 simultaneously and in a single compression action (schematically shown by the arrow 126) to finalize production of the container closure 10. The first and second die tools 122, 124 include some similar elements and profiles as the tools at the third press station 100, for example, the first die tool 122 continues to include an annular recess sized to receive the sidewall 18 which is not to be deformed or otherwise acted upon at the fourth press station 120, and the second die tool 124 again includes a recess 110 and press projection 112 even though these elements are only used to support the outer region 60 of the blank 50 rather than add further deformations at this station (the corresponding pressing portions have been removed in this case from the first die tool 122). The rotational orientation is not critical in view of the circumferential symmetry of the blank 50 at the beginning of this step in the manufacturing process.

The primary acting portions of the first and second die tools 122, 124 are configured to engage with and cut scores into the blank 50 along the depressed annular region 26 thereof. To help further illustrate this scoring action and the relatively small features causing same, expanded detail views of the primary acting portions of the first and second die tools 122, 124 are provided at FIGS. 6 and 7, showing the scoring action being performed on the depressed annular region. Moreover, a perspective view of the hollow cylindrical dies defining the primary acting portions of the first and second die tools 122, 124 is provided at FIG. 8. To this end, the first die tool 122 (shown on the bottom in the FIG. 8 illustration even though this is on the top of FIGS. 5D-7) includes a first hollow cylindrical die 128 that includes raised anvils 130 located at a position where the main scores 30, 32 are to be produced in the container closure 10, and also includes a planar support surface 132 at all regions except those immediately adjacent and surrounding the raised anvils 130. The second die tool 124 includes a second hollow cylindrical die 134 (shown on the top side of FIG. 8) defining a generally planar end surface 136 with a plurality of cutting projections 138 extending outwardly from the planar end surface 136. It will be readily understood from the perspective view of the cutting projections 138 in FIG. 8 that the cutting projections 138 are in the same configuration as all of the scores that are to be cut into the container closure 10, e.g., the appearance of the second hollow cylindrical die 134 is similar to the pattern of scores previously shown in FIGS. 4 and 4A. The planar support surface 132 and the planar end surface 136 facing one another are annular-shaped as a result of the hollow cylindrical shape of the first and second dies 128, 134. FIG. 5D also shows that the first die tool 122 may include a similar central support die 144 for engaging and supporting the blank 50 at the central button 24 during the scoring operation, this central support die 144 located in the central aperture defined by the first hollow cylindrical die 128, but it will be appreciated that such central support die 144 may also be omitted in other embodiments.

In the exemplary embodiment shown in these Figures, two of the cutting projections 138 are selected cutting projections that are larger in size than the others and therefore configured to cut the main scores 30, 32 into the container closure 10. These selected cutting projections 138 are shown in operation at the detail view of FIG. 6. As can be seen in this view, a first selected cutting projection 138*a* is positioned closer to the axial center of the container closure 10 and the second die tool 124 and is slightly larger in size than a second selected cutting projection 138*b* that is positioned radially outwardly and in close proximity to the first selected cutting projection 138*a*. FIG. 6 also shows that the two raised anvils 130 on the first die tool 122 are located directly opposite tip ends 140 of the first and second selected cutting projections 138*a*, 138*b*.

In the fully compressed state at the fourth press station 120 shown in FIG. 6, the first selected cutting projection 138*a* is inserted into the depressed annular region 26 to a depth such that a spacing from the corresponding raised anvil 130 is about 0.001 inch (appx. 25.4 μm), which is the remainder or the amount of remaining material left under the primary main score 30 that is produced by this action. By comparison, the second selected cutting projection 138*b* is inserted into the depressed annular region 26 to a depth such that a spacing from the other corresponding raised anvil 130 is about 0.002 inch (appx. 50.8 μm), which is the remainder or the amount of remaining material left under the secondary main score 32 that is produced by this action. In this embodiment, the tip end 140 of the first selected cutting projection 138*a* is located about 0.0185 inch (appx. 469.9 μm) in elevation beyond the planar end surface 136, and each of the tip ends 140 is formed with a flat face of about 0.0003 inch (appx. 7.62 μm) in width, these flat faces being sufficiently small in size so as to still be largely invisible even in the detail view of FIG. 6. Each of the raised anvils 130 defines a planar upper surface 146 that is about 0.005 inch (appx. 127 μm) in width and curved sides 148 on opposite ends of this width that taper downwardly to the recessed portion 150 that surrounds and is adjacent to both of the raised anvils 130. The recessed portion 150 provides areas for material being pressed out of the path of the selected cutting projections 138*a*, 138*b* to move to as needed during the scoring process. The positioning of the raised anvils 130 directly opposite the selected cutting projections 138*a*, 138*b* provides support for this area of the depressed annular region 26 during the scoring, and further enhances the reliability that the main scores 30, 32 will be formed to the specifications desired with the dimensions as noted throughout the description above.

Turning to the other side of the cross-section (in FIG. 5D) through the fourth press station 120 shown in FIG. 7, a series of the other cutting projections 138 are shown as they are inserted into the blank 50 to form the ancillary scores 34 in the depressed annular region 26. As can be understood from the perspective views provided at FIGS. 4A and 8, because the cross-section shown in FIGS. 5D-7 is taken generally to intersect the center (AKA where the apex of the nose portions 42 are located) of the selected cutting projections 138*a*, 138*b* configured to form the main scores 30, 32, each of the cutting projections 138 shown in FIG. 7 is forming one of the circular line arc portions 34*a* defining one of the circular trapezoid shapes of the ancillary scores 34 (and another circular line arc portion defining the interior score line 36 within the circular trapezoid shape). The tip ends 152 of each of the cutting projections 138 in FIG. 7 are inserted into the depressed annular region 26 to a depth such that a spacing from the planar support surface 132, which supports the blank 50 on an opposite side from the cutting projections 138, is about 0.0045 inch (appx. 114.3 μm), which is also the remainder or the amount of remaining material left under each ancillary score 34 produced in this action. In this embodiment, the tip end 152 of each of these cutting projections 138 is located about 0.015 inch (appx. 381 μm) in elevation beyond the planar end surface 136, and each of the tip ends 152 is formed with a flat face of about 0.001 inch (appx. 25.4 μm) in width, which is significantly thicker than the tip ends 140 on the selected cutting projections 138*a*, 138*b* for forming the main scores 30, 32. This shaping of the cutting projections 138 and the remainders left all collectively contribute to the design that encourages a shearing action only along the primary main score 30 when the container closure 10 is in use as described herein.

Thus, the planar support surface 132 and the raised anvils 130 provide support of the side of the depressed annular region 26 opposite where the cutting projections 138 are being inserted to simultaneously provide all scores into the container closure 10. In the illustrated embodiment, the planar support surface 132 is also positioned about 0.001 inch (appx. 25.4 μm) in elevation below the planar upper surfaces 146 of the raised anvils 130, such additional spacing allowing for more variations in coating or material thickness within the depressed annular region 26 of the blank 50. Such additional spacing also lowers the forces applied when scoring at the ancillary scores 34, which may be desirable in some applications. In other embodiments of the tooling, the planar support surface 132 and the top of the raised anvils 130 will be at the same relative elevation.

Some final details of the features on the first and second hollow cylindrical dies 128, 134 are best visible in the perspective view at FIG. 8. To this end, FIG. 8 shows that each of the selected cutting projections 138*a*, 138*b* for making the main scores 30, 32 extends along a generally straight curved line path in order to make the main scores 30, 32 follow these same paths on the surface of the depressed annular region 26. More specifically, the selected cutting projections 138*a*, 138*b* each include a curved nose portion 156 with an apex pointing towards the axial center of the second hollow cylindrical die 134, and convex line portions 158 on opposite ends of the nose portion 156 that define an apex of the curve facing away from the axial center. As indicated by the numbering of elements applied in FIG. 8, each of the two raised anvils 130 also includes the nose portion 156 and the convex line portions 158. The other cutting projections 138 that form the ancillary scores 34 follow a path defined by either a circular line arc portion 160 or a radial line portion 162, the former being generally concentric with the axial center of the second hollow cylindrical die 134 and the latter extending directly towards and away from said axial center. These portions for the other cutting projections 138 allow for the circular trapezoid shapes to be formed by the ancillary scores 34 as described above.

As can be seen from FIG. 5D, the blank 50 is therefore converted from the state shown and described with respect to FIG. 3D above, to the state as shown in FIG. 3E (and also generally shown in FIG. 5D). This is the finalized form where the blank 50 has become the container closure 10. The first and second die tools 122, 124 are then moved away from one another to release the container closure 10 so that it can be collected for shipping or installation and use on a container. With all the scores 30, 32, 34 being formed at the same single compression action at this fourth press station 120, no orientation dimples or other rotational orientation maintaining steps need to be done before or after this step of the manufacturing process. This further refinement by using the "all in one" station makes the manufacturing process quicker to operate, less expensive, and more reliable in operation.

Figure 9:
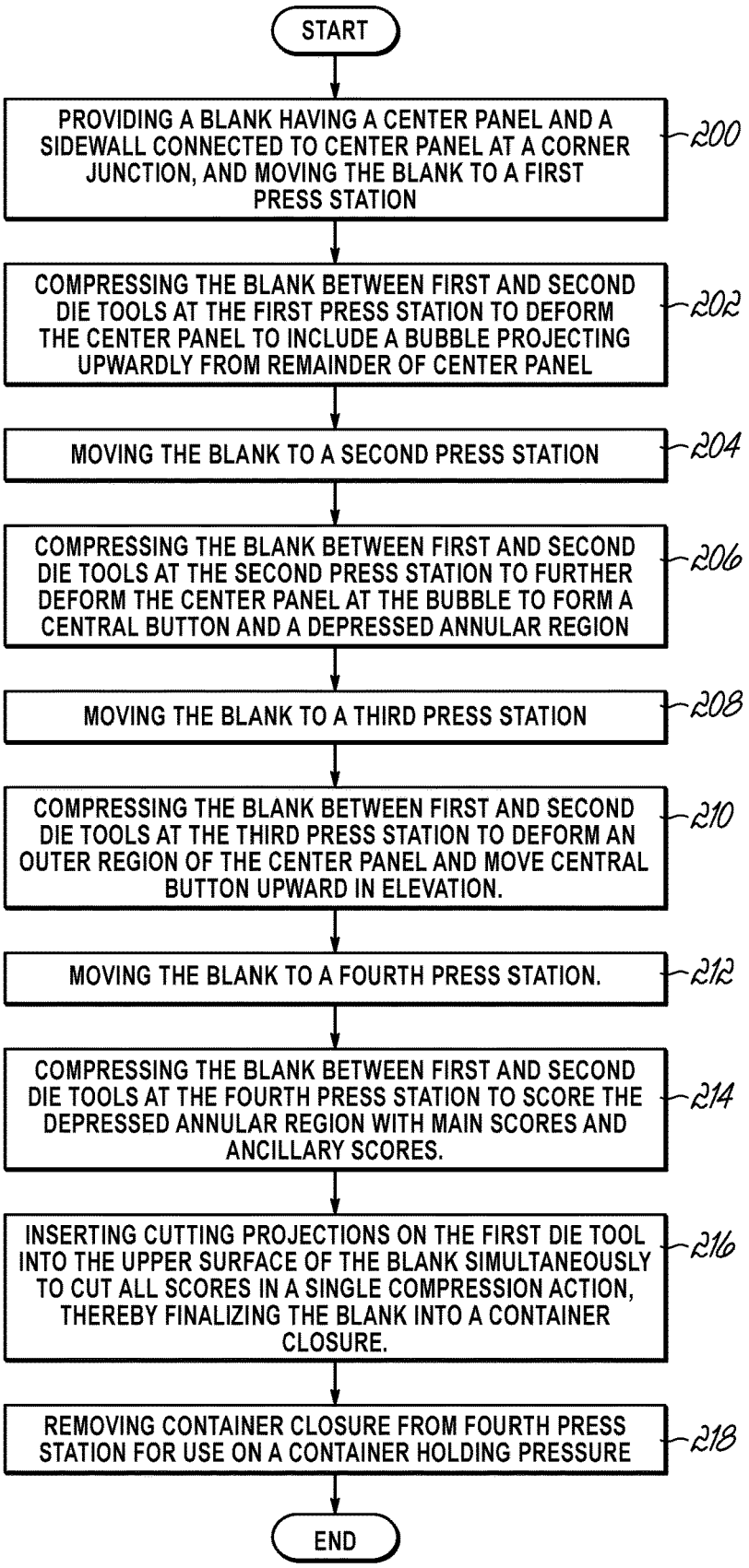
FIG. 9 is a schematic flowchart showing a method of forming a container closure from a blank using various press stations in a manufacturing tooling in accordance with the embodiments of the present invention.

Having now described the manufacturing tooling and process step-by-step with the illustrations of FIGS. 3A-3E and FIGS. 5A-5D, a summary of the manufacturing process for making a container closure 10 according to the embodiments of the present invention can now be provided. With reference to the operational flowchart of FIG. 9, the manufacturing process begins at a step 200 with providing the blank 50, which has a center panel 12 and a sidewall 18 connected to the center panel 12 at a corner junction 22. Step 200 also includes moving the blank 50 to a first press station 70. Then, at a step 202, the method includes compressing the blank 50 between first and second die tools 72, 74 at the first press station 70, which deforms the center panel 12 to include a bubble 58 projecting upwardly from a remainder of the center panel 12. This state of the blank 50 can be seen at FIG. 3B, described previously. Next, at a step 204, the blank 50 is moved to a second press station 80. At a subsequent step 206, the method includes compressing the blank 50 between first and second die tools 82, 84 at the second press station 80, which further deforms the center panel 12 around the bubble 58 to form a central button 24 and a depressed annular region 26 surrounding the central button 24. This state of the blank 50 can be seen at FIG. 3C.

After that, at a step 208, the blank 50 is moved to a third press station 100. Then, at a step 210, the blank 50 is compressed between first and second die tools 102, 104 of the third press station 100, which deforms an outer region 60 of the center panel 12 to add further profiles while also moving the central button 24 upwardly in elevation. The resulting state of the blank 50 can be seen at FIG. 3D. Next, at a step 212, the blank the blank 50 is moved to a fourth press station 120. As set forth above, as all deformations and features made up to this point of the manufacturing process are circumferentially symmetrical on the blank 50, there is advantageously no need to provide orientation-maintaining dimples or features and use associated equipment to assure alignment during movement between the various press stations 70, 80, 100, 120. At the fourth press station 120, in a further step 214, the blank 50 is compressed between first and second die tools 122, 124 to score the depressed annular region 26, so as to include main scores 30, 32 and ancillary scores 34. As stated at step 216, the cutting projections 138 at the fourth press station 120 are inserted into one surface (upper surface in use on a container) of the blank 50 simultaneously to perform the scoring and make all scores in one compression action simultaneously, this step also finalizing the blank 50 and converting it to the container closure 10. Finally, at a step 218, the container closure 10 is removed from the fourth press station 120 and moved for shipping or use on a container that is to hold pressure, as described in detail throughout this specification.

By modifying the manufacturing tooling and method to use the new "all in one" press station for simultaneously scoring all score lines into the container closure 10, the efficiency and reliability of manufacturing is improved significantly. Various technical problems and potential failure points provided in conventional methods can be avoided, such as by avoiding any potential for a rotational misalignment that would place scores or other profile shapes and features in the incorrect location. The container closure 10 resulting from this process is better-suited for use on jar-like containers that can contain vacuum pressures or pressure differentials that preferably need to be released before opening the container. Of course, the scoring at one station concept can be redesigned to work with many other types of container closures as well, and the processes developed herein can be applied more broadly to the field of container closures, e.g., not just to the exemplary embodiment closure shown as an example herein. The manufacturing process improvements will therefore clearly benefit both companies that sell such products in containers as well as the end consumers.

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the scope of the Applicant's general inventive concept.

What is claimed is:

1. A method of manufacturing a push button container closure (10) from a sheet of material, the method comprising:

providing a blank (50) of a container closure including a generally planar center panel (12) and a sidewall (18) extending from a periphery (20) of the center panel at a corner junction (22) for processing at a series of first, second, third, and fourth press stations;

deforming, using the first press station (70), the center panel of the container closure to include a bubble (58) projecting upwardly from a remainder of the center panel;

further deforming, using the second press station (80), the center panel at the bubble to form a central button (24) and a depressed annular region (26) surrounding the central button, with the central button located in relative elevation below the corner junction of the container closure;

deforming, using the third press station (100), an outer region (60) of the center panel located between the depressed annular region and the sidewall to reshape the center panel at the outer region and thereby move the central button upwardly closer to an elevation of the corner junction of the container closure;

scoring, using the fourth press station (120), the depressed annular region surrounding the central button to provide main scores (30, 32) and ancillary scores (34) into an upper surface (16) of the container closure, wherein all scores cut into the container closure are formed only at the fourth press station in a single compression action, and a selected one of the main scores is cut deeper into material of the container closure than all other scores such that the central button can be pushed to sever the center panel at the selected one of the main scores to release a pressure differential across the container closure.

2. The method of claim 1, wherein the fourth press station includes a second die tool including a plurality of cutting projections and a first die tool opposite the second die tool, and the step of scoring using the fourth press station further comprises:

cutting the main scores and the ancillary scores into the upper surface of the container closure simultaneously by insertion of the plurality of cutting projections into the container closure at the fourth press station as the first and second die tools move towards one another.

3. The method of claim 1, wherein the fourth press station includes a second die tool including a plurality of cutting projections and a first die tool opposite the second die tool and including raised anvils extending above adjacent portions of the first die tool and aligned with selected cutting projections on the second die tool that are configured to form the main scores, and the step of scoring using the fourth press station further comprises:

supporting a lower surface of the container closure with the raised anvils of the first die tool as the selected cutting projections of the second die tool are inserted into the upper surface of the container closure opposite the raised anvils to thereby produce the main scores.

4. The method of claim 3, wherein the first die tool of the fourth press station includes a planar support surface at all portions except adjacent to the raised anvils, and the step of scoring using the fourth press station further comprises:

supporting a lower surface of the container closure with the planar support surface of the first die tool as the cutting projections of the second die tool are inserted into the upper surface of the container closure to thereby produce the ancillary scores.

5. The method of claim 4, wherein the planar support surface of the first die tool is positioned 0.001 inch (appx. 25.4 μm) below a top of the raised anvils, to define an additional spacing between the first and second die tools when pressed together to lower forces applied by the fourth press station to the container closure at positions where the ancillary scores are cut into the upper surface of the container closure.

6. The method of claim 1, wherein the step of scoring using the fourth press station further comprises:

cutting the upper surface of the container closure at the main scores such that each of the main scores is a curved line including a concave nose portion including an apex extending towards the central button, and convex line portions extending from both ends of the concave nose portion and each including an apex extending away from the central button.

7. The method of claim 1, wherein the step of scoring using the fourth press station further comprises:

producing a primary score and a secondary score as the only main scores in the container closure, the primary score having a larger depth into the upper surface of the container closure than the secondary score while also being positioned between the central button and the secondary score, such that the secondary score serves as an anti-fracture score while the primary score is configured for severing to release the pressure differential when the container closure is engaged with a container, wherein the step of producing the primary score and the secondary score further comprises:

cutting the upper surface of the container closure such that about 0.001 inch (appx. 25.4 μm) of material thickness remains in the container closure under the primary score; and cutting the upper surface of the container closure such that about 0.002 inch (appx. 50.8 μm) of material thickness remains in the container closure under the secondary score.

8. The method of claim 1, wherein the step of scoring using the fourth press station further comprises:

cutting the upper surface of the container closure at the ancillary scores such that each of the ancillary scores is defined by one or more of: circular line arc portions generally concentric with the central button, and radial line portions extending towards and away from a center of the central button, wherein the step of cutting the upper surface of the container closure at the ancillary scores further comprises:

cutting at least three of the ancillary scores to include both circular line arc portions and radial line portions to thereby define circular trapezoid shapes for these ancillary scores, with the circular trapezoid shapes being continuous except where interrupted by a region of the main scores, and these ancillary scores generally surrounding a periphery of the central button and the main scores on the container closure such that force applied to the central button is directed to focus towards severing the container closure at the main score.

9. The method of claim 1, wherein the step of scoring using the fourth press station further comprises:

cutting the upper surface of the container closure such that about 0.0045 inch (appx. 114.3 μm) of material thickness remains in the container closure under each of the ancillary scores.

10. The method of claim 1, further comprising:

moving the container closure from the first press station to the second press station, then the third press station, and then the fourth press station such that the steps of deforming and scoring can be performed sequentially on the container closure, wherein no orientation dimples or features are formed in the container closure for guiding the moving of the container closure between press stations because an angular orientation of the container closure does not need maintained with all main scores and ancillary scores being formed by the same fourth press station and all other press stations producing circumferentially symmetrical deformations in the container closure.

11. A tooling assembly for manufacturing a push button container closure (10) from a blank (50) of a container closure, the blank including a generally planar center panel (12) and a sidewall (18) extending from a periphery (20) of the center panel at a corner junction (22), wherein the tooling assembly comprises:

a first press station (70) including first and second die tools (72, 74) that press together to deform a center panel of the container closure to include a bubble (58) projecting upwardly from a remainder of the center panel;

a second press station (80) including first and second die tools (82, 84) that press together to further deform the center panel at the bubble to form a central button (24) and a depressed annular region (26) surrounding the central button, with the central button located in relative elevation below the corner junction of the container closure;

a third press station (100) including first and second die tools (102, 104) that press together to deform an outer region (60) of the center panel located between the depressed annular region and the sidewall to reshape the center panel at the outer region and thereby move the central button upwardly closer to an elevation of the corner junction of the container closure;

a fourth press station (120) including first and second die tools (122, 124) that press together to score the depressed annular region surrounding the central button to provide main scores (30, 32) and ancillary scores (34) into an upper surface (16) of the container closure, the second die tool including a plurality of cutting projections (138) that cut into the upper surface of the container closure to form the main scores and the ancillary scores when the first and second die tools are pressed together, with one of the cutting projections being larger in size than a remainder of the cutting projections to form a selected one of the main scores so as to be cut deeper into material of the container closure than all other scores such that the central button can be pushed to sever the center panel at the selected one of the main scores to release a pressure differential across the container closure, wherein the fourth press station is configured so as to cut all scores into the container closure only at the fourth press station and in a single compression action, and such that the container closure is scored at only one of the press stations in the tooling assembly.

12. The tooling assembly of claim 11, wherein the first and second die tools of the fourth press station are each hollow cylindrical dies defining annular-shaped surfaces that engage with the depressed annular region when the first and second die tools are pressed together to score the container closure.

13. The tooling assembly of claim 11, wherein the first die tool of the fourth press station further comprises:

raised anvils extending above adjacent portions of the first die tool and aligned with selected cutting projections on the second die tool of the fourth press station that are configured to form the main scores, the raised anvils thus being positioned to support a lower surface of the container closure as the selected cutting projections of the second die tool are inserted into the upper surface of the container closure opposite the raised anvils to thereby produce the main scores.

14. The tooling assembly of claim 13, wherein the raised anvils include planar upper surfaces that extend between curved sides that taper away from the planar upper surfaces, with the planar upper surfaces fully aligned with and following a path defined by a cutting edge of the selected cutting projections on the second die tool, wherein the planar upper surfaces of each of the raised anvils defines a width between the curved sides of about 0.005 inch (appx. 127 μm).

15. The tooling assembly of claim 13, wherein each of the raised anvils and each of the selected cutting projections configured to form the main scores follow a curved line path when viewed in plan view, the curved line path including a concave nose portion including an apex extending towards an axial center of the first and second die tools, and convex line portions extending from both ends of the concave nose portion and each including an apex extending away from the axial center of the first and second die tools.

16. The tooling assembly of claim 13, wherein the second die tool of the fourth press station includes only two selected cutting projections and the first die tool of the fourth press station includes only two raised anvils, one of the selected cutting projections closer to an axial center of the second die tool being sized larger than the other of the selected cutting projections, such that the one of the selected cutting projections cuts a primary score into the upper surface of the container closure that has a larger depth than a secondary score cut by the other of the selected cutting projections into the upper surface of the container closure.

17. The tooling assembly of claim 16, wherein the one of the selected cutting projections is spaced about 0.001 inch (appx. 25.4 μm) from one of the raised anvils when the first and second die tools of the fourth press station are pressed together, thereby leaving about 0.001 inch (appx. 25.4 μm)

of material thickness in the container closure under the primary score, and wherein the other of the selected cutting projections is spaced about 0.002 inch (appx. 50.8 μm) from another of the raised anvils when the first and second die tools of the fourth press station are pressed together, thereby leaving about 0.002 inch (appx. 50.8 μm) of material thickness in the container closure under the secondary score, the secondary score thereby being configured to serve as an anti-fracture score while the primary score is configured for being severed to release the pressure differential.

18. The tooling assembly of claim 13, wherein the first die tool of the fourth press station further comprises:

a planar support surface at all portions except adjacent to the raised anvils, the planar support surface being positioned to support the lower surface of the container closure as the cutting projections of the second die tool are inserted into the upper surface of the container closure to thereby produce the ancillary scores, wherein the planar support surface of the first die tool is positioned 0.001 inch (appx. 25.4 μm) below planar upper surfaces of the raised anvils, to define an additional spacing between the first and second die tools when pressed together around a location where the ancillary scores are formed in the container closure.

19. The tooling assembly of claim 13, wherein each of the cutting projections configured to form the ancillary scores follows a path when viewed in plan view which is defined by one or more of: circular line arc portions generally concentric with an axial center of the first die tool, and radial line portions extending towards and away from the axial center of the first die tool, and further wherein at least three of the cutting projections forming ancillary scores have both circular line portions and radial line portions to thereby define circular trapezoid shapes for these ancillary scores, with the circular trapezoid shapes being continuous except where interrupted by a region of the cutting projections that are configured to make the main scores, wherein the second die tool of the fourth press station further comprises a planar support surface spaced from the raised anvils, and wherein each of the cutting projections configured to form the ancillary scores is spaced about 0.0045 inch (appx. 114.3 μm) from the planar support surface when the first and second die tools of the fourth press station are pressed together, thereby leaving about 0.0045 inch (appx. 114.3 μm) of material thickness in the container closure under each of the ancillary scores.

20. The tooling assembly of claim 11, wherein none of the first, second, third, or fourth press stations forms orientation features in the container closure because an angular orientation of the container closure can be varied between each of the press stations.

* * * * *